US005415394A

United States Patent [19]

Hall

[11] Patent Number: 5,415,394

[45] Date of Patent: May 16, 1995

[54] SAFETY BASE

[76] Inventor: Roger E. Hall, 134 N. Spruce, Elizabethtown, Pa. 17022

[21] Appl. No.: 940,752

[22] Filed: Sep. 8, 1992

Related U.S. Application Data

[60] Continuation of Ser. No. 669,088, Mar. 15, 1991, abandoned, which is a continuation-in-part of Ser. No. 595,577, Oct. 11, 1990, abandoned, which is a division of Ser. No. 442,465, Nov. 30, 1989, Pat. No. 4,979,740, which is a continuation of Ser. No. 194,276, May 16, 1988, which is a continuation of Ser. No. 647,534, Sep. 5, 1984, Pat. No. 4,744,561, which is a continuation-in-part of Ser. No. 472,241, Mar. 4, 1983, Pat. No. 4,531,733, which is a continuation-in-part of Ser. No. 395,279, Jul. 6, 1982, Pat. No. 4,398,715, which is a continuation of Ser. No. 234,618, Feb. 17, 1981, abandoned, which is a division of Ser. No. 18,844, Mar. 8, 1979, Pat. No. 4,266,768, which is a continuation-in-part of Ser. No. 758,638, Jan. 12, 1977, abandoned.

[51] Int. Cl.[6] ..... A63B 71/00

[52] U.S. Cl. ..... 273/25

[58] Field of Search ..... 273/25, 344, 345, 346, 273/DIG. 30

[56] References Cited

U.S. PATENT DOCUMENTS

| | | | |
|---|---|---|---|
| 357,675 | 2/1887 | Keating | 273/25 |
| 2,046,126 | 6/1936 | Latina | 273/25 |
| 2,103,148 | 12/1937 | Conrad | 273/25 |
| 2,122,266 | 6/1938 | Seys | 273/25 |
| 2,275,547 | 3/1942 | Mouch | 273/25 |
| 2,683,037 | 7/1954 | Ruczynski | 273/345 |
| 3,176,364 | 4/1965 | Dritz | 24/304 |
| 3,204,958 | 9/1965 | Velsquez | 273/25 |
| 3,341,199 | 9/1967 | Madsen | 273/25 |
| 3,466,039 | 9/1969 | Golomb | 273/25 |
| 3,508,747 | 4/1970 | Orsatti | 273/25 |
| 3,572,705 | 3/1971 | Wyble | 273/25 |
| 3,703,785 | 11/1972 | Perry | 273/25 |
| 3,862,756 | 1/1975 | Selliken | 273/25 |
| 3,971,558 | 7/1976 | Gardetto | 273/25 |
| 3,997,162 | 12/1976 | Cullin | 273/345 |
| 4,055,343 | 10/1977 | Stuart | 273/345 |
| 4,723,779 | 2/1988 | Hauser | 273/25 |

*Primary Examiner*—Theatrice Brown

*Attorney, Agent, or Firm*—Kerkam, Stowell, Kondracki & Clarke; John C. Kerins

[57] ABSTRACT

A base and ground anchor system uses a resilient fastening arrangement to severably hold the base so as to minimize the likelihood of injury to a sliding base runner, the ground anchor for the base having a pair of handles extending from the sides thereof to facilitate placement and correct positioning of the anchor in the ground, and the base having design features which provide varying severability characteristics of the base from the ground support system. Included among the base design features are the provision of integral channels in the base bottom, the provision of a two-piece base cover, wherein the base top may be of a different hardness and/or thickness than the base bottom which has fastening recesses therein to severably attach to the ground support, and the provision of a range of base cover hardnesses foam core densities, and numbers of fastener recesses from which a base can be designed according to the level of play in which the base will be used.

13 Claims, 8 Drawing Sheets

FIG. 7
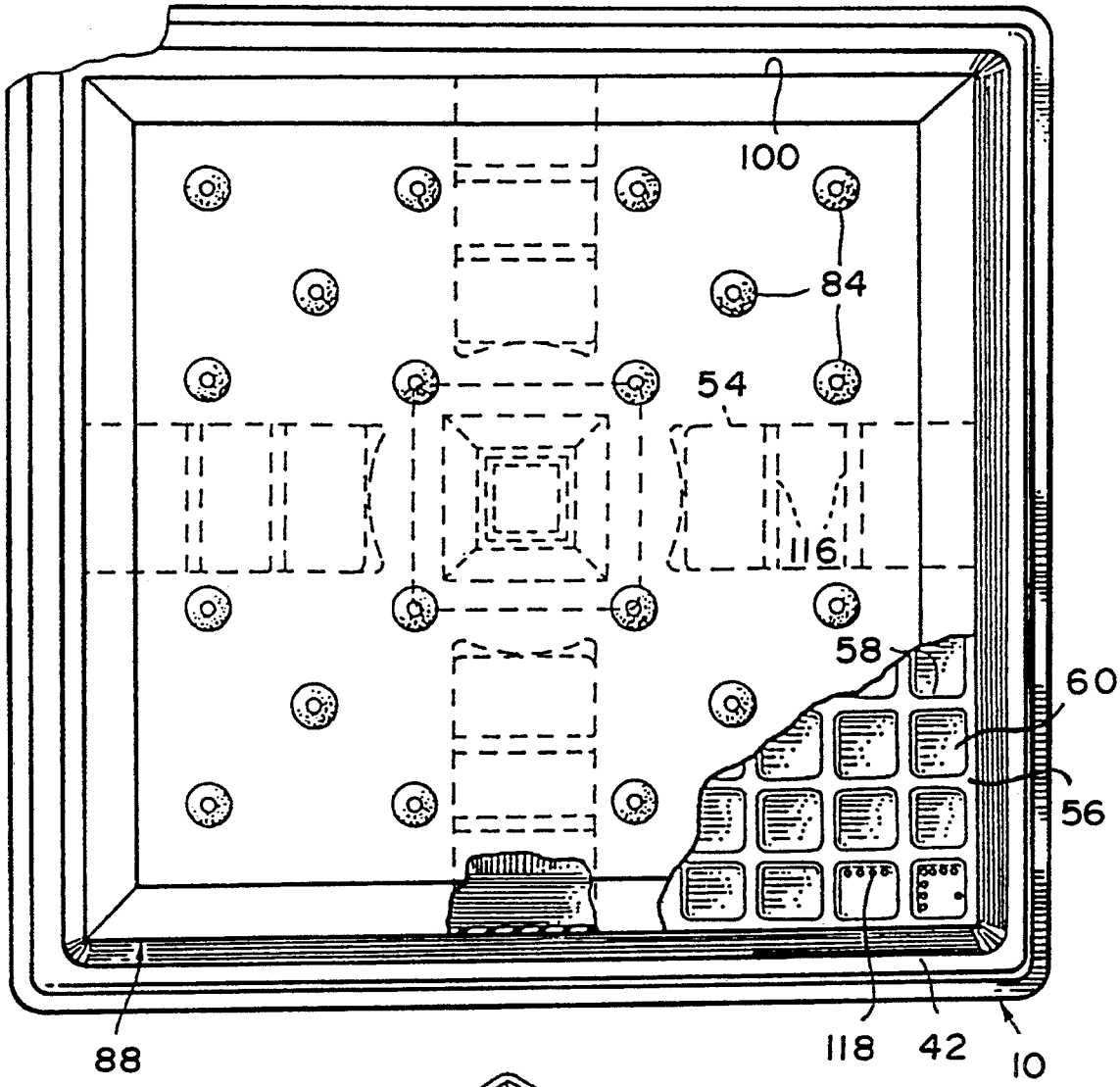
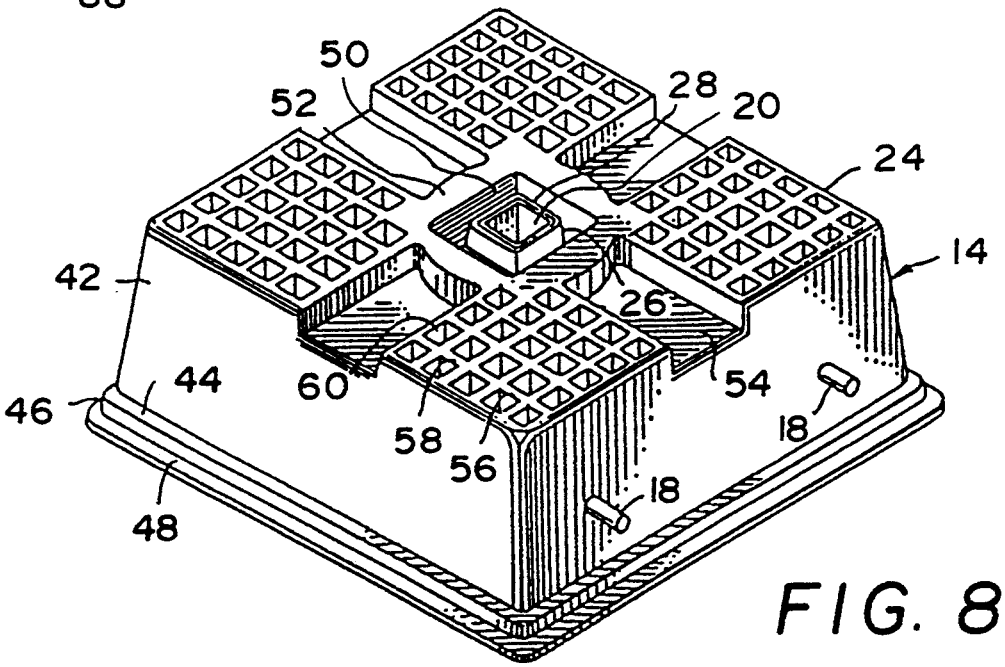
FIG. 8

FIG. 9
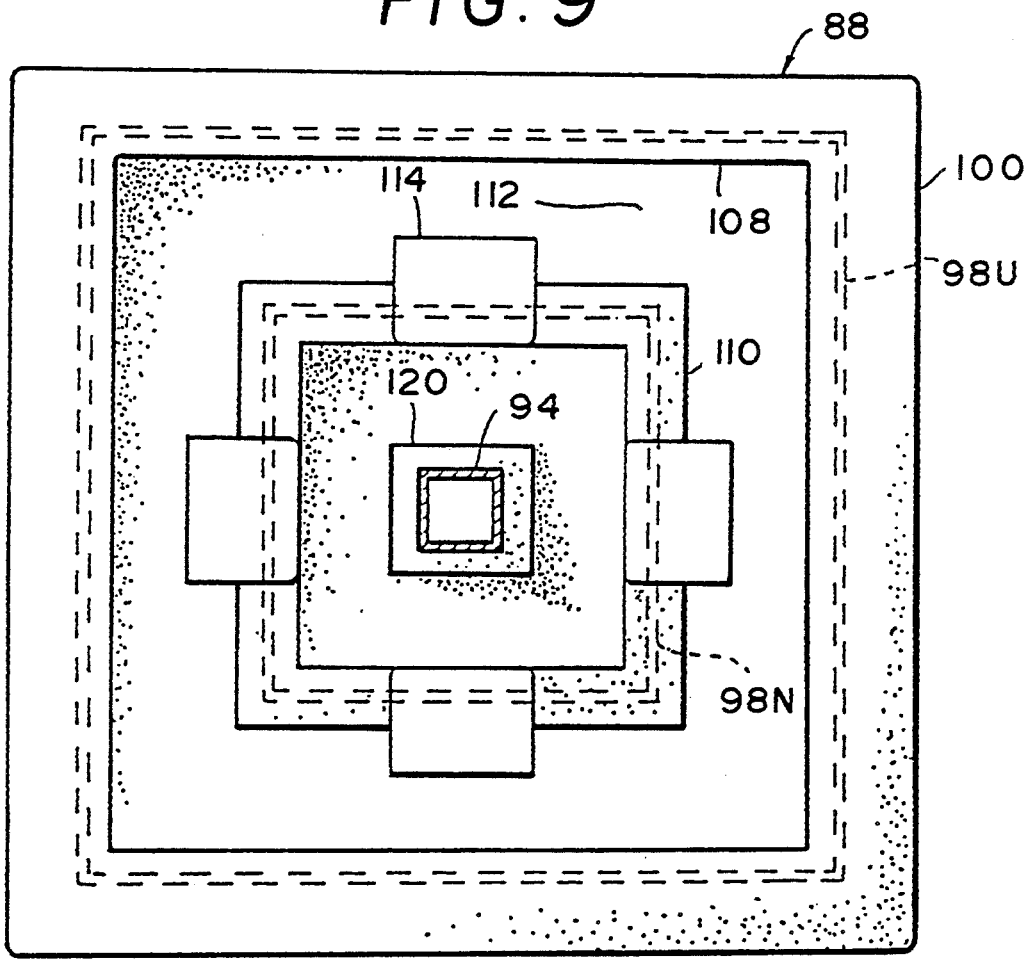
FIG. 12
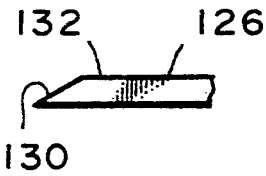
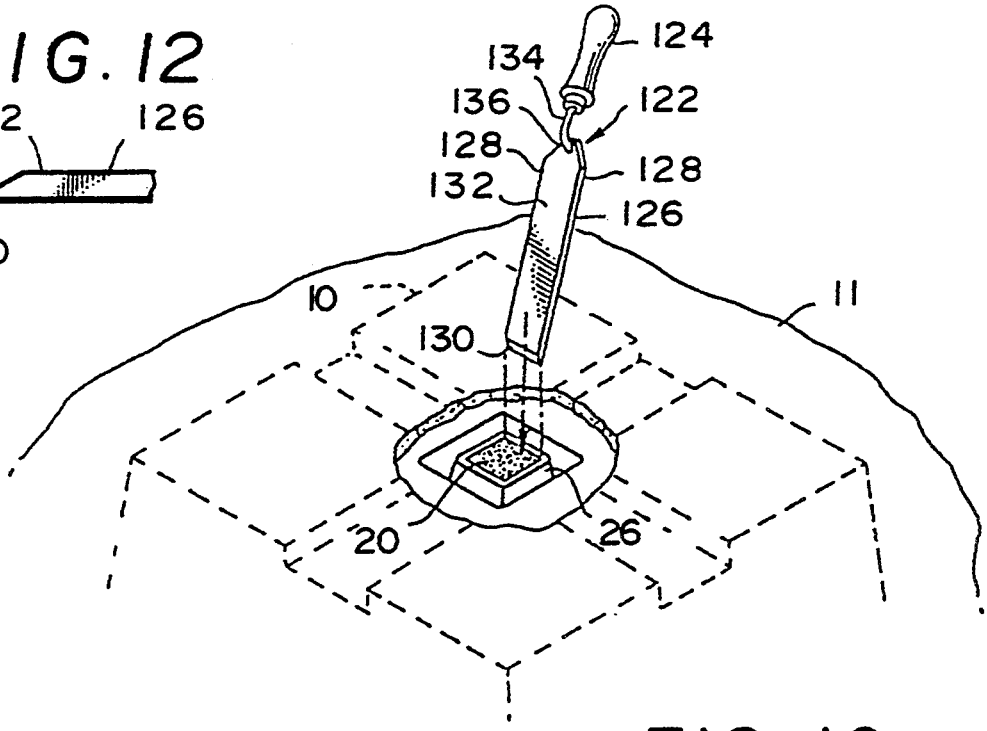
FIG. 10

SAFETY BASE

This application is a continuation of application Ser. No. 07/669,088, filed Mar. 15, 1991 (abandoned) which is a continuation-in-part of my application entitled "SAFETY BASE WITH ANCHOR, METHODS OF USING AND MAKING, AND ASSOCIATED TOOL", Ser. No. 595,577, filed Oct. 11, 1990 now abandoned. That application was in turn a divisional application of Ser. No. 442,465, filed Nov. 30, 1989, now U.S. Pat. No. 4,979,740, which was a continuation of Ser. No. 194,276, filed May 16, 1988, now abandoned, which in turn was a continuation of Ser. No. 647,534, filed Sep. 5, 1984, now U.S. Pat. No. 4,744,561, which was a continuation-in-part of Ser. No. 472,241 filed Mar. 4, 1983 now U.S. Pat. No. 4,531,733. That application was in turn a continuation-in-part of Ser. No. 395,279, filed Jul. 6, 1982, now U.S. Pat. No. 4,398,715, issued Aug. 16, 1983, which was a continuation of Ser. No. 234,618, filed Feb. 17, 1981, and now abandoned. Ser. No. 234,618 was a divisional application of Ser. No. 018,844, filed Mar. 8, 1979, now issued as U.S. Pat. No. 4,266,768 on May 12, 1981. Ser. No. 018,844 was in turn a continuation-in-part of Ser. No. 758,638, filed Jan. 12, 1977, and now abandoned. These applications and patents are hereby incorporated by reference.

BACKGROUND OF THE INVENTION

This invention relates to a base and a base anchor structure for playing baseball or similar sports. The invention further relates to methods of using and making such bases. Additionally, the invention relates to a tool specially adapted for use with such base supports.

Injuries are a widespread problem in the playing of sports. In particular, injuries often occur in baseball, softball, or similar sports wherein players slide into bases. If the base is fixed tightly into the ground, a player sliding into the base will often develop a leg injury. Even if the player sliding into the base does not develop a specific leg injury, the wear and tear of repeated slidings into a base may cause deterioration in the players's leg or legs over a long period of time. In addition, injuries occur to other parts of the body.

In order to minimize the likelihood of injury and/or long term damage caused by repeatedly placing great stress upon legs, numerous baseball bases have been designed to yield under lateral force. Some prior art bases have used springs to allow the base to move upon the application of force, whereas other bases have used magnets to allow the bases to move. Those prior art bases which use springs are disadvantageous in that the spring or springs will tend to deform after sufficient use. This may cause the displacement of the base from its proper position. Although strong springs may minimize this problem, such stronger springs may prevent the base from yielding sufficiently to avoid injury to the sliding baseball runner. On the other hand, magnets may too easily allow the sliding of the base. Both the spring-biased bases as well as the magnetically secured base are disadvantageous in that metallic parts such as springs and magnets may rust and lose their efficiency with time. Further, dirt may collect next to the faces of the magnetic pieces and reduce their effectiveness.

Another problem with prior art bases is complexity of construction as, for example, the requirement of numerous time consuming steps in assembly of the bases and/or associated ground support structure.

Prior art anchoring systems for bases have often relied upon the placement of concrete within the ground. However, the concrete often cracks under adverse conditions such as exposure to water which freezes. Prior art ground anchor systems for bases have often been deficient in that they allow migration or movement of the anchor system. In other words, the ground anchor system moves within the dirt. Alternately, the dirt may be eroded from the side of the ground anchor system. In either case, the chances of injury are greatly increased in that a base runner may slide into the anchor system instead of the base. The base is usually covered by a canvas material and includes a firm and resilient inner body sufficient to retain the shape of the base during play but is somewhat yieldable in response to contact.

A problem common to numerous of the prior art yieldable bases is the difficulty in matching the yield or sever characteristics of the base with the class of player who will be using the base. A base which is designed to sever upon a hard slide by an 80 pound player will not be especially suitable for use by a 200 pound professional baseball player. Likewise, a base well suited for a professional baseball player would not yield sufficiently when used by a young baseball player. However, changing the bases to accommodate different classes of players has generally been difficult. Additionally, prior art anchoring systems and associated bases have heretofore been generally costly due to variations in the assembly procedure depending upon what type of base was being built. In other words, a base designed for a professional player may require different assembly steps than a base made for a young baseball player. Non-standard techniques of manufacture and, sometimes, the need for different anchoring systems depending upon the type of base, increase the cost.

Although numerous tools have heretofore been used for cleaning prior art bases, such tools have often been inadequate to conveniently clean a ground anchor system for proper operation.

OBJECTS AND SUMMARY OF THE INVENTION

Accordingly, it is a primary object of the present invention to provide a new and improved base and anchor support.

A further object of the present invention is to provide a new and improved method of using bases in accordance with the class of player.

A further object of the present invention is to provide a new and improved method of making bases.

A still further object of the present invention is to provide a new and improved tool for use in cleaning bases and/or their associated anchor systems.

A more specific object of the present invention is to provide a base, ground anchor system, and associated method such that the base may easily be fastened to the ground anchor system so as to sever under a sufficiently high force relative to the class of baseball player using the base.

Yet another object of the present invention is to provide a ground anchor system which is resistant to movement and damage.

A further object of the present invention is to provide a base, anchor system, and method of making the base which are relatively simple to assemble by the ultimate user, low in cost, and easy to manufacture.

A still further object of the present invention is to provide a tool which is specifically adapted for cleaning the ground anchor system of the present invention.

The above and other objects of the present invention, which will become apparent as the description proceeds, are realized by an athletic contact device comprising a base having a resilient exterior and a foam interior, the exterior including a lower mounting surface having a generally horizontal portion, the generally horizontal portion including a plurality of recesses, each recess having an engagement portion disposed at its entrance and defining a hole which is narrower than at least part of the recess, and wherein the recesses and engagement portions are operable to severably fasten the base to a lower ground support having upwardly extending resilient fasteners which extend into the recesses such that one or more of the engagement portions is severable from the corresponding fastener or fasteners upon a sufficiently high lateral force. The exterior includes a single integral piece comprising the lower mounting surface and a cover portion, the recesses being within the integral piece. The lower mounting surface further comprises beveled edges extending out and downwardly. Each of the engagement portions is a lip defining a circular hole. The device further comprises a lower ground support having a plurality of upwardly extending resilient fasteners engageable to the engagement portions. The lower ground support comprises a rigid support member with a plurality of resilient fasteners fixed thereto. The plurality of resilient fasteners are integral with each other and are integrally part of a resilient encasing portion extending above and below the support member at least at its periphery. The support member is a support plate, and the lower ground support further comprises: a support tube fixed to extend downwardly from the support plate; a ground anchor housing having a receiving tube disposed therein, the receiving tube receiving the support tube to removably hold the support plate relative to the ground anchor housing.

The ground anchor housing is wider at its bottom than at its top and includes side walls having at least one peripheral outwardly extending ground holding portion operable to resist removal of the ground anchor housing from the ground. The ground anchor housing is adapted for filling with concrete or other type of cement (i.e., soft substance that hardens like stone upon drying) and includes concrete holding means for holding the ground anchor housing to concrete. The concrete holding means comprises a plurality of upwardly extending ribs on a top surface of the ground anchor housing, the ribs defining a plurality of dirt receiving recesses. The encasing portion has a plurality of locator means on its bottom and is operable to mate with a plurality of complimentary locator means on the top of the ground anchor housing, the locator means and complimentary locator means together minimizing any pivoting of the rigid support member relative to the ground anchor housing.

The present invention may alternately be described as an athletic contact device comprising a base having: a resilient unibody exterior including an upper cover and a lower mounting surface having a generally horizontal portion, a plurality of resilient fastening means integral with the unibody exterior and disposed on the generally horizontal portion, the fastening means operable to hold the base to a lower ground support; and a foam interior. The device further comprises a lower ground support having a plurality of mating fastening means to fasten to the fastening means on the base.

The present invention may alternately be described as an athletic contact device comprising: a lower ground support having a rigid support member and a plurality of resilient fastening means, the fastening means operable to mate with fastening means on a base placed above the lower ground support; a resilient encasing portion disposed above and below the support member at least at its periphery; and wherein the lower ground support further comprises: a support tube fixed to extend downwardly from the support member; a ground anchor housing having a receiving tube disposed therein, the receiving tube receiving the support tube to removably hold the support member relative to the ground anchor housing. The ground anchor housing is wider at its bottom than at its top and includes side walls having at least one peripheral outwardly extending ground holding portion operable to resist removal of the ground anchor housing from the ground. The ground anchor housing is adapted for filling with concrete or other type of cement and includes concrete holding means for holding the ground anchor housing to concrete. The ground anchor housing is rigid plastic.

The invention may alternately be described as an athletic contact device comprising: a lower ground support having a rigid support member and a plurality of resilient fastening means, the fastening means operable to mate with fastening means on a base placed above the lower ground support; a ground anchor housing having a receiving hole disposed therein, the receiving hole receiving a support tube extending downwardly from the support member to removably hold the support member relative to the ground anchor housing, the ground anchor housing operable to serve as a mold for concrete or other type of cement placed within the ground anchor housing prior to disposing the ground anchor housing within the ground. The ground anchor housing further comprising concrete (or cement) holding means for holding the ground anchor housing to concrete and wherein the concrete holding means comprises a plurality of upwardly extending ribs on a top surface of the ground anchor housing, the ribs defining a plurality of dirt receiving recesses.

The present invention may alternately be described as an athletic contact system comprising: a lower ground support as discussed above; and a plurality of bases selectively and severably attachable to the lower ground support by way of the fastening means, each base having a resilient exterior and a foam interior, and wherein the bases sever from the ground support at different lateral forces due to differences in characteristics of the bases, the characteristics selected from the group of: variations in exterior thickness, variations in the hardness of the exterior cover, both the base top and base bottom, and/or variations in the foam density of the foam interior.

The method of adapting an athletic contact device to various classes of players according to the present invention comprises the steps, not necessarily in order of: disposing a ground anchor at least partially within the ground; removably securing a rigid support member to the ground anchor, the rigid support member having a plurality of resilient lower fastening means attached thereto; selecting a base having a resilient exterior and a foam interior and a plurality of resilient upper fastening means operable to mate with the lower fastening means, the base being selected dependent on the thickness and- /or hardness of its exterior and/or the density of its foam interior to realize a desired severability level corresponding to the class of players which are to use the base, the lower fastening means accommodating bases of different severability levels corresponding to differences in their exterior thicknesses and/or foam densities; and removably securing the selected base to the rigid support member by way of the upper and lower fastening means.

The method of making the base according to the present invention comprises the steps of: placing moldable material within a rotational mold; rotating the mold with the application of heat to form a resilient base exterior; disposing foaming material within the exterior; and foaming the foaming material within the exterior.

The tool especially adapted for removing dirt from a ground anchor receiving tube of a base according to the present invention comprises: a handle, a blade attached to the handle, the blade having a width of at least 1 inch and extending lengthwise along two parallel side edges at least 5 inches to an end edge opposite the handle and perpendicular to the side edges, the blade width being within $\frac{1}{8}$ inch of the width of the receiving tube.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 7 shows a view taken along lines 7—7 of FIG. 4 and with parts broken away.

FIG. 8 shows a perspective view of the ground anchor housing of the present invention.

FIG. 9 shows a view taken along lines 9—9 of FIG. 4 and illustrating the underside of a ground support plate assembly used with the present invention.

FIG. 10 shows a perspective view of the ground anchor and a tool used for cleaning the ground anchor.

FIG. 12 shows a detail side view of a part of the tool.

DETAILED DESCRIPTION

Figure 1:
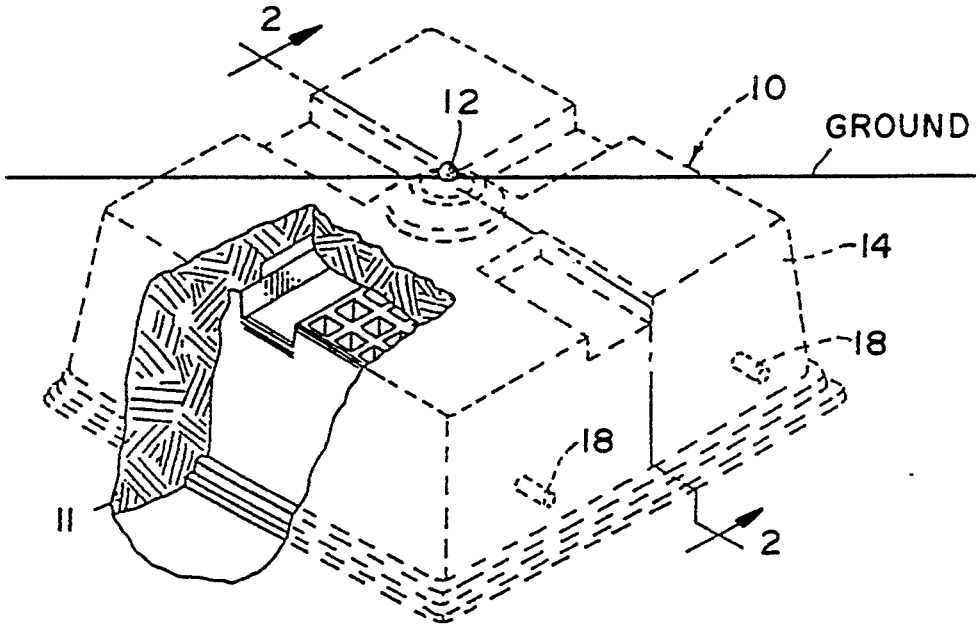
FIG. 1 shows a perspective view of a ground anchor system according to the present invention and with a locator plug disposed therein.
Figure 2:
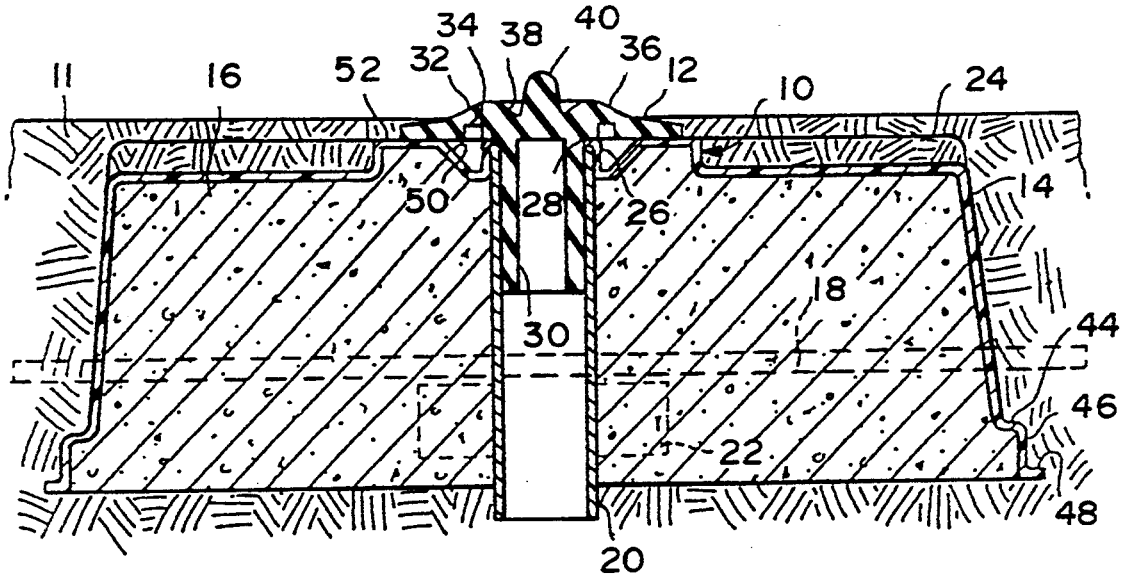
FIG. 2 shows a cross-section view along lines 2—2 of FIG. 1.

Turning now to FIGS. 1 and 2, a ground anchor system 10 and associated locator plug 12 according to the present invention will be described in detail. Both FIGS. 1 and 2 show the ground anchor system disposed within the ground with the locator plug 12 extending above the ground. FIG. 1 is a perspective view with parts of the dirt removed for illustrative purposes, whereas FIG. 2 is a cross-section view along lines 2—2 of FIG. 1.

The ground anchor system 10 comprises a ground anchor housing 14, preferably made of hard plastic material (to shed water) and having a square cross-section taken in a horizontal plane (thereby maximizing resistance to pivoting of the anchor system 10 within the ground).

The ground anchor system 10 further includes a block of concrete (or other type of cement) 16 disposed within the housing 14, two wooden dowels 18 extending through holes on opposite sides of housing 14 and set in the concrete 16, and a square cross-section receiving tube 20 having a reinforcing bar 22 also set within the concrete 16. The receiving tube 20 extends upwardly to the top 24 of the housing 14 and is received within a upwardly extending square cross-section portion 26 which has an inwardly extending lip 28 at its top to prevent the receiving tube 20 from moving above the top 24. The locator plug 12, preferably made of rubber, is shown placed within the top of the receiving tube 20. The locator plug 12 helps to locate the ground anchor system 10 although anchor 10 is buried within the ground. Additionally, the rubber of the locator plug 12 minimizes the likelihood of injury caused by persons falling upon the ground adjacent the buried metallic receiving tube 20. Further, the locator plug 12 serves to shed water away from the metallic receiving tube 20.

With particular reference to FIG. 2, the locator plug 12 has a square shaft portion 30 extending up to a head portion 32 having four channels 34, each of which parallels one of the sides of shaft portion 30. Shaft portion 30 is hollow with a cylindrical hole. The top of the head portion 32 has 360 degrees of symmetry and includes upwardly tapered surface portions 36, annular recess 38 and locator pin 40. The taper on surface portions 36 is such that a rack or similar tool used to smooth off a ball field will overshoot or just barely tip the top of the locator pin 40, thereby avoiding the dislocation of the locator plug 12.

Continuing to view FIGS. 1 and 2, but also considering the perspective view of FIG. 8, the specifics of the ground anchor housing 14 will be discussed. In particular, the top 24 of housing 14 is preferably fifteen inches square, whereas the sides 42 are tapered outwardly to a horizontally extending surface 44, vertically extending surface 46 and horizontally extending bottom portion 48. (As used herein, "horizontal" and "vertical", "top", and "bottom" are with reference to directions defined upon the anchor housing 14.) The outward tapering of the sides 42 and especially the peripheral outwardly extending ground holding portions 44 and 48 serve to stabilize the ground anchor housing 42 within the ground as best appreciated from the view of FIG. 2. For the illustrated embodiment, the housing 14 is fifteen inches square at its top and eighteen inches square at the bottom ground holding or horizontal portion 48.

The top 24 of the housing 14 has a central hole defined by the portion 26 and within enclosing lips 28, the receiving tube 20 being disposed therein. Just outside of the tubular portion 26 is a recessed portion 50 surrounded by an upper surface 52 having the same horizontal level as the upper end of portion 26. Disposed outside of the upper surface portion 52 are four orthogonal channels 54, which preferably may slant slightly downwardly towards the sides 42 so as to repel or drain water away from the center and the metallic receiving tube 20. At each of the four corners of the top 24 are waffle portions 56, each of which includes a plurality of upwardly extending ribs 58 (having their tops level with upper surface 52) with dirt receiving recesses 60 disposed between the ribs 58. The top 24 of housing 14 is hollow within the ribs 58 such that the concrete 16 (FIG. 2 only) will extend into the ribs 58 and serve as a concrete holding means for increasing the surface area between the concrete and the top 24.

The assembly of the ground anchor system 10 is relatively straightforward. The housing 14 is turned upside down and the receiving tube 20 is slid into the tubular portion 26. The dowels 18 are placed within the housing 14. Although FIG. 2 shows the reinforcing bar 22 as being parallel to the dowels 18, it could alternately be perpendicular to the dowels 18. Concrete is placed within the housing 14 and extends to within the concrete holding ribs 58. After the concrete has sufficiently hardened, the ground anchor system 10 including the housing 14, concrete 16 and associated parts are placed into the ground 11 such that the top 24 is slightly below the ground level as shown in FIG. 2. Dirt will extend substantially over the top 24 except that locator plug 12 protrudes slightly from the dirt and minimizes dirt going into the receiving tube 20.

Figure 3:
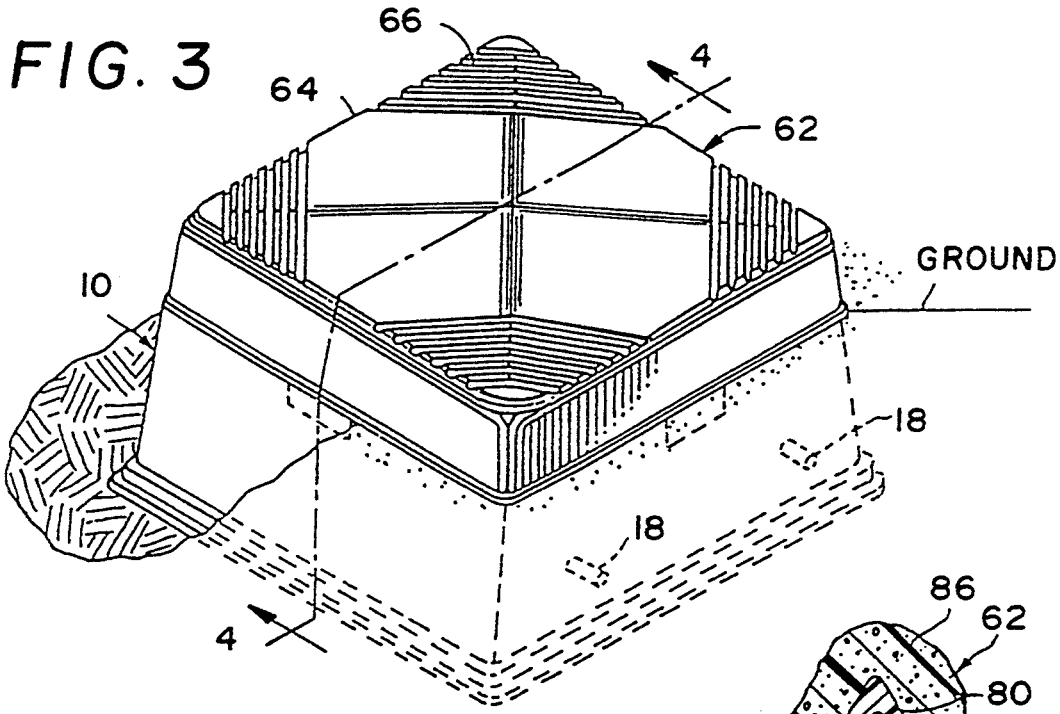
FIG. 3 shows a perspective view of the ground support system with a base attached thereto.
Figure 4:
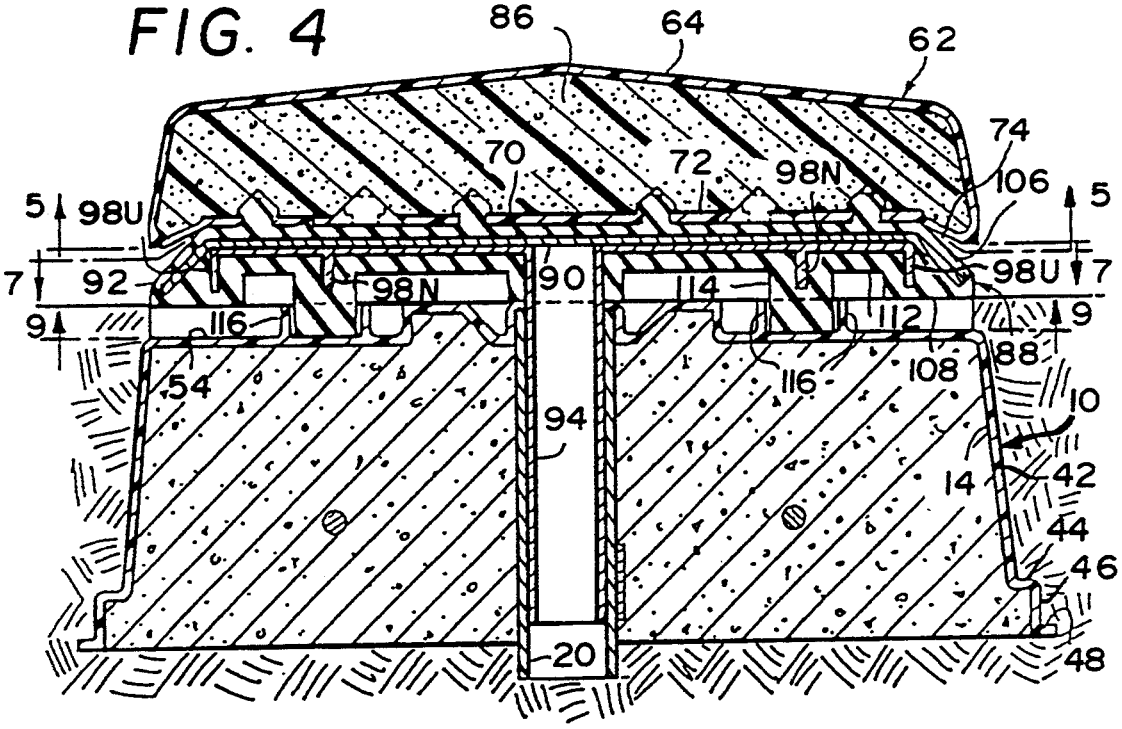
FIG. 4 shows a cross-section view taken along lines 4—4 of FIG. 3.
Figure 5:
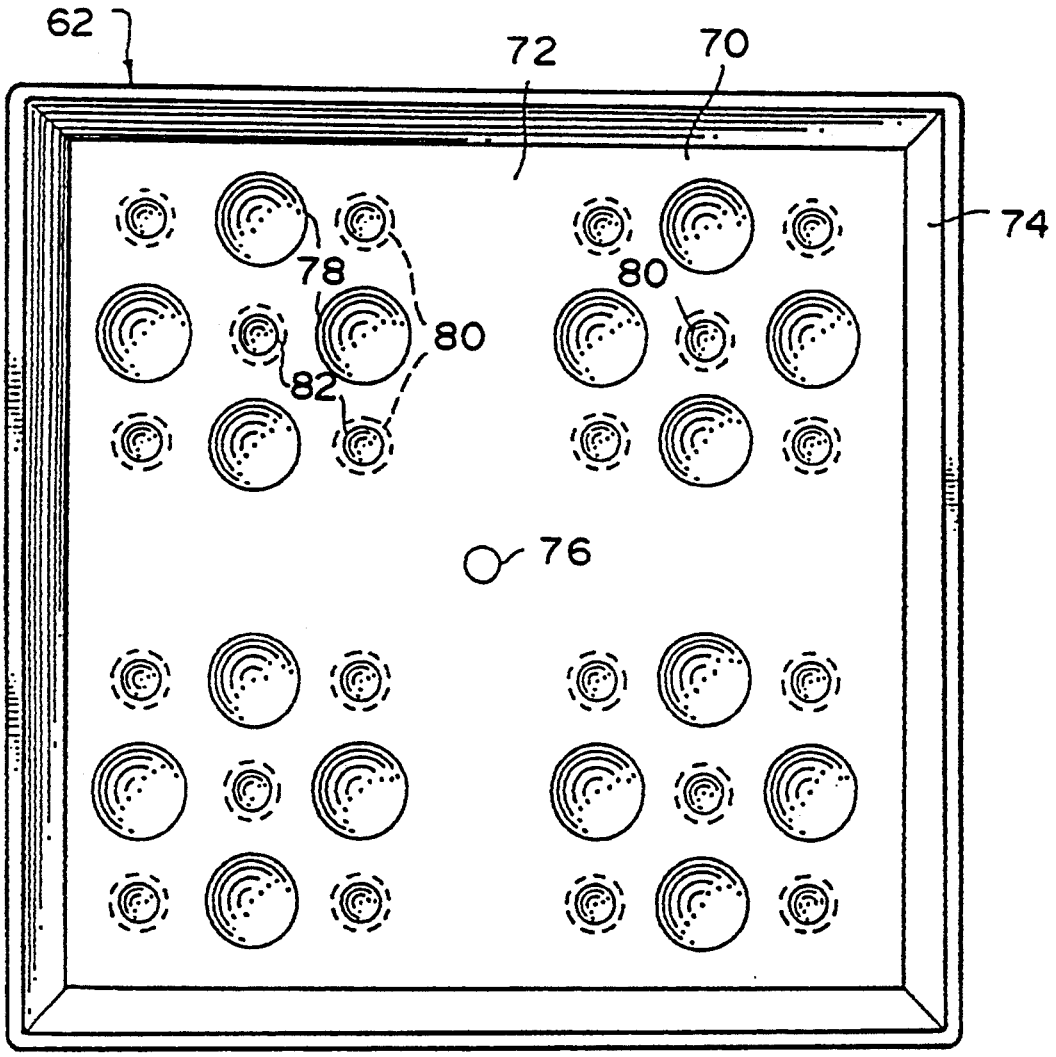
FIG. 5 shows a view taken along lines 5—5 of FIG. 4 illustrating the underside of the present base.
Figure 6:
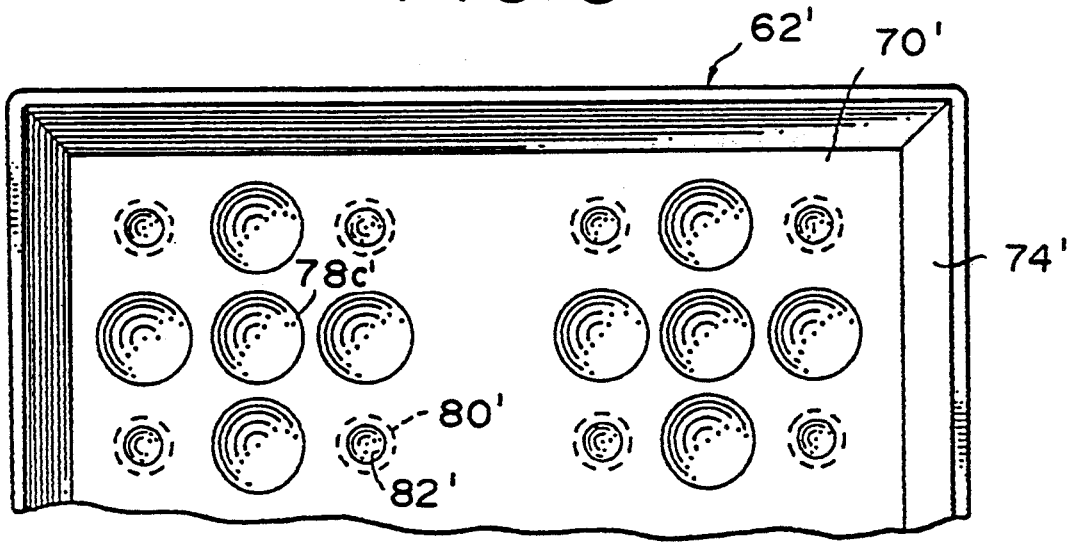
FIG. 6 shows an underside view of an alternate base with portions broken away.

Turning now to FIG. 3, 4, 5, and 6, the base 62 of the present invention will be discussed in detail. FIG. 3 shows a perspective view of the base 62 mounted upon the ground anchor system 10, whereas FIG. 4 shows a cross-section view taken along lines 4—4 of FIG. 3. FIG. 5 shows a view of the underside of the base 62 as taken along lines 5—5 of FIG. 4. FIG. 6 shows a bottom view of an alternate base 62'.

The base 62 includes an exterior 64 having a number of grooves or flutes 66 in the top portion or upper cover 68. The grooves 66 are very helpful in maintaining traction and provide a visual indication of where the runner should step. The grooves which are disposed at the corners at a 45° angle to the sides of the base, also provide a visual indication to the runner that the base is a severable base. The grooves comprise alternate ridges and recesses in the exterior of the base. The unibody exterior 64 further includes a lower mounting surface portion 70 having a generally horizontal portion 72 with beveled edges 74 extending out and downwardly. A filler plug 76 may be adhered or otherwise fixed to the center of the horizontal portion 72 in order to plug a hole in the exterior 64. The plug 76 (shown in FIG. 5 only) may alternately be plastic welded into the center of the horizontal portion 72 and serves to plug a hole (not shown) used in forming the base 62.

As best shown in FIG. 5, the underside horizontal portion 72 includes a number of conical depressions 78 intermixed in an array with recesses 80.

Figure 11:
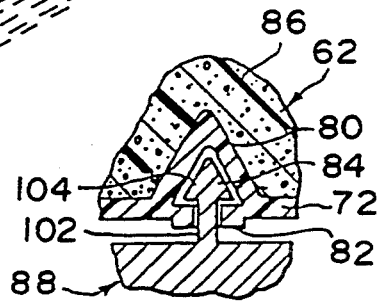
FIG. 11 shows a side cross-section detail illustrating how the base is severably attached to its support.

The details of construction of the recesses 80 are shown in the detailed cross-section view of FIG. 11. In particular, each of the recesses 80 is integral with the horizontal portion 72 and the unibody exterior 64 and includes an engaging portion lip 82 which is circular and defines a hole narrower than the base of the recess 80. Accordingly, the recess 80 and associated engaging lip serve as a resilient fastening means operable to severably fasten to a lower resilient fastening means 84 as discussed in detail below.

Disposed within the exterior 64 is a resilient, cellular foam material 86. As will be discussed in detail below, the base 62 has different characteristics depending upon the density of the foam 88 within the exterior 64 and the thickness and hardness of the resilient exterior 64. Additionally, the characteristics of the base may be dependent upon the number of recesses 80 disposed within the horizontal portion 72 of the base. For example, as shown in the alternate embodiment of FIG. 6, the base 62' is constructed substantially identically to base 62 except that an extra conical recess 70C' is used at the center of each of the three-by-three arrays defined by depressions 78 and recesses 80. In other words, the FIG. 6 embodiment has an extra conical depression 78C' in place of the center recess as used with the FIG. 5 embodiment. Basically then, the FIG. 6 embodiment has fewer of the upper fastening means realized by the recesses 80' and engagable lip portions 82' than the FIG. 5 embodiment. By varying the number of recesses 80 on the base 62, one may vary the severability characteristics of the base.

Concentrating now on FIGS. 4, 7, and 9 an intermediate support structure 88 will be discussed in detail. FIG. 7 shows a top view of the intermediate structure 88 as mounted upon the ground anchor housing 14 with parts broken away and corresponds to lines 7—7 of FIG. 4. FIG. 9 shows a bottom view of the intermediate member 88 as seen from lines 9—9 of FIG. 4.

As best shown in FIG. 4, the intermediate structure 88 is disposed intermediate the ground anchor system 10 and the base 62. Intermediate structure 88 and anchor 10 together constitute a lower ground support for base 62. The intermediate structure 88 comprises a rigid, preferably metallic, upper support member or plate 90 which is generally flat except for downwardly projecting edges 92. The edges 92 extend around the square periphery of the plate 90. A support tube 94 is bolted (bolts not shown) or otherwise fixed to the support member 90 to extend downwardly therefrom. The support tube 94 preferably has a square cross-section to match and fit within the square cross-section of the receiving tube 20 of the ground anchor system 10. (The interior of tube 20 may be considered to be a receiving hole.) Attached on the underside of the upper support plate 90 is a double ribbed member 96 having square inner and outer ribs 98N and 98U respectively. Although the ribbed member 96 is shown as extending inwardly to the support tube 94, it could alternately be a picture-frame type of structure with ribs 98U and 98N defining its edges.

Surrounding the support member or plate 90 is a resilient encasing portion 100 (preferably rubber) with a plurality of upwardly extending resilient fasteners 84 (see also FIG. 11), each of which includes a shaft portion 102 and a head portion 104. As shown in FIG. 11, the generally conical head 104 serves to resiliently and severably hold the intermediate member 88. At the edges of the top encasing portion 100 are downwardly beveled portions 106 extending in a square around the square edges of portion 100.

As best shown on the bottom view of FIG. 9, the underside of the encasing portion 100 includes an outer ridge portion 108 separated from an inner ridge portion 110 by a depression 112. Mounted at four locations along the inner ridge 110 are four locator blocks 114 which extend below the level of outer ridge 108 (see FIG. 4) which is at the same level as most of the inner ridge 110. The blocks 114 have a length (long dimension in FIG. 9) corresponding to the width of the channels 54 such that the locator blocks 114 fit in corresponding ones of the channels 54 with the ribs 56 at the edge of channels 54 capturing the blocks 114. This minimizes any tendency of the intermediate structure 88 to rotate relative to the ground anchor system 10. Additionally, as shown in FIGS. 4 and 7, cross channel ribs 116 may be used in each of the channels 54 to further capture the locator blocks 114. The cross channel ribs 116 could include a narrow slit at their bottoms and along the floor of channels 54 to allow water drainage if desired. Alternately, the cross channel ribs 116 could simply be solid as shown in FIG. 4.

In addition to use of the locator blocks 114 as locator means to locate the intermediate member 88 with respect to corresponding locator means (channels 54 and cross-channel ribs 116) in the ground anchor housing 14, a plurality of cleats 118 (shown in FIG. 7 only) are disposed upon the bottom of the encasing portion 100. The cleats 118, only some of which are shown in FIG. 7, are used to further lock the intermediate member or structure 88 to the ground anchor 10. Specifically, the cleats 118, which are preferably conically shaped with cut-off ends, would extend to within the dirt receiving recesses 60 in the waffle portions 56 of ground anchor housing 14. Preferably, there are two rows of cleats on the outer ridge 108 of encasing portion 100, a single row of cleats around the inner ridge 110, and two rows of cleats on the inner square 120 of the encasing portion 100. The cleats 118 on the inner square 120 would extend downwardly into the recessed portion 50 (see especially FIG. 8). Each "row" of cleats would of course be a number of cleats extending in a square around the encasing portion 100. Together, all of the cleats 118 extend downwardly from the encasing portion 100 into dirt disposed within the dirt receiving recesses 60 and within the recessed portion 50, thereby tightly gripping the intermediate member 88 to the ground anchor 10 by way of dirt on top of housing 14.

With reference now to FIG. 10, the tool 122 of the present invention will be discussed in detail. FIG. 10 shows a perspective view illustrating the ground anchor 10 within the ground 11 and illustrating one use of the tool 122. The tool 122 includes a handle 124 and a blade 126. The blade 126 has a width of at least 1 inch and extends lengthwise along two parallel side edges 128 at least 5 inches to an end edge 130 which is opposite the handle and perpendicular to the side edges. The end edge 130 is beveled away from its front surface 132 as best shown in the side view of FIG. 12 with parts broken away. The blade 126 is attached to the handle 124 by a shaft 134, the blade 126 narrowing at portion 136 where the shaft 134 is attached.

The actual width of the blade 126 should be within $\frac{1}{8}$ inch of the width of the receiving tube 20. For a preferred embodiment, the width of the blade 126 would be $\frac{1}{2}$ inches and the length of the straight parallel side edges 128 would be $8\frac{1}{4}$ inches. As a preferred range, the width and indicated length should be within 10% of the preferred values.

FIG. 10 illustrates schematically how the tool 122 may be used to clean the receiving tube 20 of the ground anchor system 10. In particular, upon removal of the locator plug 12 (FIGS. 1 and 2), it may be necessary to remove some dirt from the receiving tube 20 in order to accommodate the supporting tube 94 (FIG. 4). The specially adapted tool 122 may be easily inserted into the receiving tube 20 and used to remove dirt. The width of blade 126 being just narrower than the receiving tube 20 (within $\frac{1}{8}$ inch of the width of receiving tube) and the bevel on end edge 130 facilitate the easy removal of dirt from the receiving tube 20.

The tool 122 is additionally useful for removing dirt from the locator block receiving recess within channel 54 and defined between the cross channel ribs 126 (refer back to FIG. 4). In order to place intermediate member 88 properly above the ground support or anchor 10, the dirt must be sufficiently cleared between the cross channel ribs 116 such that the locator block 114 will properly seat therebetween. Accordingly, the distance between the cross channel ribs 116 is substantially identical to the width of the receiving tube 20 such that the blade 126 will readily fit between the cross channel ribs 116 and facilitate easy removal of dirt therefrom.

The tool 122 is further useful in separating the intermediate member 88 from the ground anchor 10. In particular, the cleats 118 (FIG. 7 only) tend to hold the intermediate structure 88 to the ground anchor 10. By insertion of the blade 126 of tool 122 into the channel 54 and movement of the handle 24 upwardly, the intermediate structure 88 can be easily separated from the ground anchor 10. Finally, the tool 122 is further useful for smoothing dirt over the ground anchor 10 after removal of the base 62 and intermediate structure 88. In particular, the ball field upon which the present device operates may be readily used for purposes other than baseball (or for baseball using bases at different locations), by removal of the bases such as base 62 and intermediate structure 88, after which the side edges 128 of blade 126 may be used to smooth dirt over the ground anchor 10 and locator plug 12 which would be inserted therein (as shown in FIG. 2).

The base 62 is operable to separate, partially or wholly, from the intermediate structure 88 upon the application of a sufficiently high lateral force. In particular, a sliding base runner will push the base 62 inwardly such that tapered portion 74 (see especially FIG. 4) will cooperate with beveled portion 106, thereby converting at least some of the lateral force to include an upwardly directed force tending to pull the fasteners 84 out of the recesses 80 (see FIG. 11). Generally, the fasteners 84 will hold and simply allow some flexing of the base 62 relative to the ground intermediate structure 88. However, potentially injury causing force will at least server some of the fasteners 84 thereby lessening the stress on the base runner's leg.

The particular desired severability level or characteristic will be dependent upon the class of player which will be using the base. A base which severs its connection upon a hard slide by an 80-pound ten year old will sever too easily for use by a professional. Accordingly, an important feature of the present invention is the provision of various techniques for varying the severability characteristics of the base dependent upon the class of players.

Referring back to FIGS. 5 and 6, one technique for varying the severability characteristics is to vary the number of fasteners. In particular, with all other things being equal, the base 62 of FIG. 5 will hold more tightly to the intermediate structure 88 than the base 62' of FIG. 6 because the base of FIG. 5 includes an extra fastening means recess 80 at each of the four corners. Although FIG. 7 shows five upwardly extending fasteners 84, one may alternately use nine upwardly extending fasteners. Then by simply varying the number of recesses 80 as opposed to depressions 78 (FIG. 5), any number between and including one to nine fasteners 84 may actually be operable at each of the four corners of the base 62. The conical depressions 78 do not lock or fasten to the fasteners 84 and, thus, the fasteners 84 which extend upwardly into the conical depressions 78 do not perform any gripping function except when used with a base having a recess corresponding to their location. Accordingly, the same encasing portion 100 and intermediate structure 88 may be used for any of the bases 62 regardless of the number of fasteners 84 which are to be engaged.

An additional method of varying the severability characteristic of the bases 62 is by control of the thickness of the exterior 64 (FIG. 4) of the base 62. The unibody exterior 64 of base 62 is made with a rotational molding process as discussed below and therefore has some variations in thickness at different parts of its exterior. However, an illustrative example of variation in thickness for a medium hardness polyvinyl chloride (PVC) exterior may be as follows:

| Type of Base | Approximate Thickness (Inches) |
|---|---|
| Youth | 3/32 |
| Teen | ⅛ |
| Adult | 3/16 |
| Pro | 7/32 rigidity |

As an alternative to varying the exterior thickness, (or in addition to), the density and/or rigidity of the resilient exterior may be varied to vary the severability of the base. These type of variations can be made and can be expressed in terms of a hardness measurement of the material.

As a further method of varying the rigidity and thus the severability characteristics of the base 62, the density of the resilient, cellular foam material 86 within the exterior 64 may be varied. In particular, the foam material 86 preferably has a free rise density of between two and six pounds per cubic foot. The foam material 86, is preferably a polyurethane flexible foam of high resilience polyester or polyether base. The actual density of the foamed material when placed within the exterior 64 will depend upon the volume within the exterior 64 and the amount of material placed therein. For example, the density of the foam 86 for a pro or professional level base 62 is approximately seven pounds per cubic foot, it being noted that this density is higher than the density in the indicated preferred free rise density range due to the restrictions of volume within the exterior 64. The actual figures for the density of the foam within the base would also depend upon the type of foam.

Thus, it will be seen that the severability characteristics of the base 62 can be varied to suit the class of player based upon three parameters; the number of engaged fasteners, the thickness/hardness of the cover or exterior of the base, and the density of the foam within the base. The factors are interrelated in that variations in one may be countered by variations in another of the factors.

The method of use of the present base to accommodate various classes of players comprises the steps, not necessarily in order, of:

(a) disposing the ground anchor 10 at least partially within the ground;

(b) removably securing the rigid support member (plate 90) to the ground anchor, with the resilient lower fastening means (fasteners 84) attached thereto;

(c) selecting a base 62 having a resilient exterior and a foam interior and a plurality of resilient upper fastening means (recesses 80 and lips 82) which mate with the lower fasteners 84, the base being selected dependent upon the thickness of its exterior and/or the density of its foam to realize a desired severability level corresponding to the class of players which are to use the base, the lower fastening means 84 accommodating bases of different severability levels corresponding to differences in their exterior thickness and/or foam densities; and (d) removably securing the selected base to the support member 90 by way of the fasteners.

As will be readily appreciated, the above steps are not necessarily in order, in that one could select the base prior to disposing the ground anchor within the ground. However, step (a) will generally be performed first. The base could be selected and secured to the support member 90 prior to removably securing support member 90 to the ground support 10 by sliding the support tube 94 into the receiving tube 20 (FIG. 4). Alternately, the base 62 might be attached after the support member 90 is already disposed on the ground anchor 10.

The method of making the base 62 according to the present invention uses rotational molding to realize a unibody exterior which is highly advantageous. In particular, moldable material, such as liquid for forming polyvinyl chloride, is placed within a rotational mold. As known in the art, the rotational mold turns about 360 degrees (in all three axes) so as to force the liquid to the exterior of the mold. The mold is then rotated with the application of heat to form a resilient base exterior. After the base exterior has sufficiently hardened, foaming material, such as a flexible high resilience polyester or polyether base material is disposed within the exterior of the base. The foaming material may be supplied to the interior of the base exterior by way of a hole corresponding to plug 76 in FIG. 5. Additionally, several small pin holes may be disposed in the exterior such that the foaming material going into the hole may push the air within the exterior out of the pin holes. The foaming material is foamed within the unibody exterior of the base 62. If desired, the plug 76 may than be placed in the base 62 (plug is shown in FIG. 5 only).

The shape of the rotational mold used to form the exterior 62 is, of course, identical to the shape of the exterior 64. With reference to FIGS. 5 and 6 it will be readily appreciated that the mold used to make base 62 may also be used to make the base 62' by simply adding a series of conical attachments to the interior of the mold corresponding to the additional depressions 78C' used in base 62'. However, bases 62 having different severability levels or characteristics may be made even without this slight change in the mold by simply putting a larger amount of material into the rotational mold to realize a thicker exterior 64 for greater rigidity (greater resistance to severance). Alternately, less material could be inserted into the rotational mold to make the exterior 64 thinner for lower rigidity and less resistance to severance. Further, variations in the amount of foamed material placed into the base 62 may change the severability characteristics of the base without any necessity of changing the mold used for producing the base.

Figure 13:
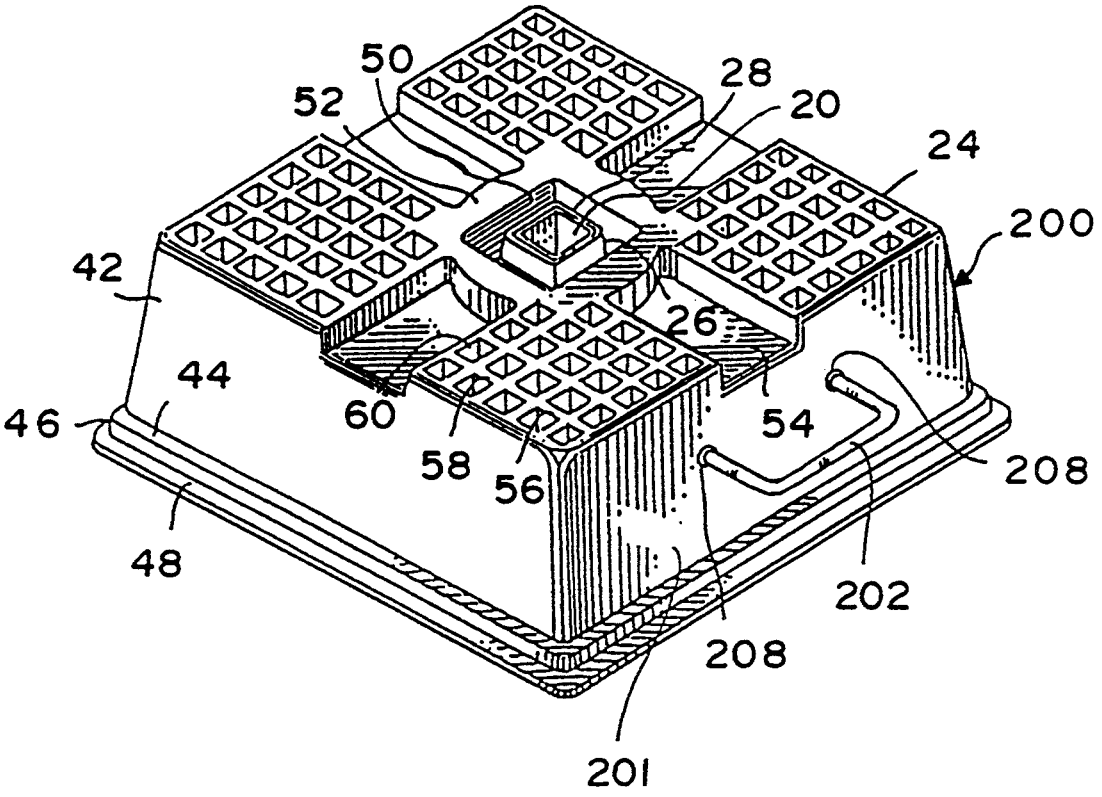
FIG. 13 shows a perspective view of the ground anchor housing according to an alternative preferred embodiment of the present invention.
Figure 16:
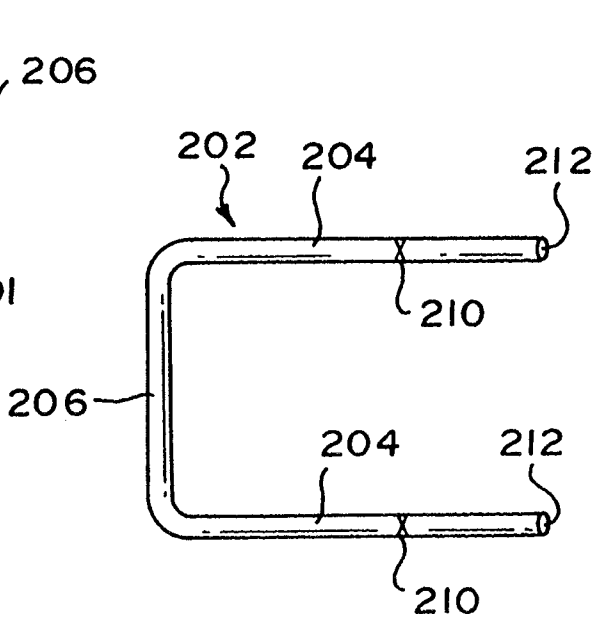
FIG. 16 shows a top view of the handle adapted to be fitted into the ground anchor housing of FIG. 13.

Turning now to FIGS. 13–18, various modifications to the foregoing base system which provide improved performance and ease of use will now be discussed. A ground anchor housing 200 is depicted in FIG. 13, which may be in most respects identical to the ground anchor housing shown in FIG. 8. Ground anchor housing 200 replaces wooden dowels 18 with a pair of anchor housing handles 202, one of which is seen in FIG. 13 extending from side wall 201, and one of which is hidden from view in that Figure, but is disposed at the opposite parallel side wall of the anchor housing, as better seen in FIG. 14.

As can be seen in looking concurrently at FIGS. 13–16, handles 202 have two parallel arms 204 joined at one end by a transverse bar 206, each of the handles preferably being an integral member formed by bending straight rod stock material into the depicted configuration. The transverse bar provides a gripping surface which is spaced apart from and extends substantially parallel to the side wall of the ground anchor housing.

The arms 204 of handles 202, which are preferably of about a 3/8" diameter, are inserted through corresponding 3/8" bores 208 in the anchor housing, the bores being spaced apart at the same distance (about five inches) as the arms 204. As with dowels 18, the arms 204 are inserted prior to the pouring and curing of concrete or other compound such as cement into the interior of anchor housing 200. The bend 210 in each arm is provided such that the tip 212 of each arm can rest on the underside of the top surface 214 of the anchor housing for initial support, while holding the portion of the handle 202 extending outside the anchor housing 200 substantially parallel with the planes of the upper and lower portions of the anchor housing. It should be kept in mind that, when viewing FIG. 14, the anchor housing is to be inverted from the orientation shown for the pouring of the concrete, so that the arm tips 212 will, in fact, rest on surface 214 by virtue of gravitational forces.

Figure 14:
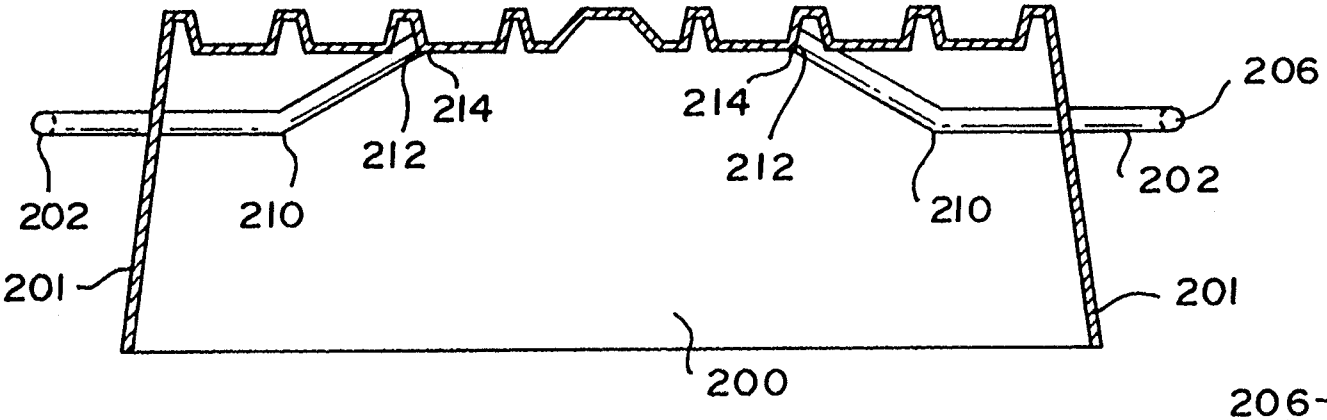
FIG. 14 shows a cross-section view of the ground anchor housing of FIG. 13.
Figure 15:
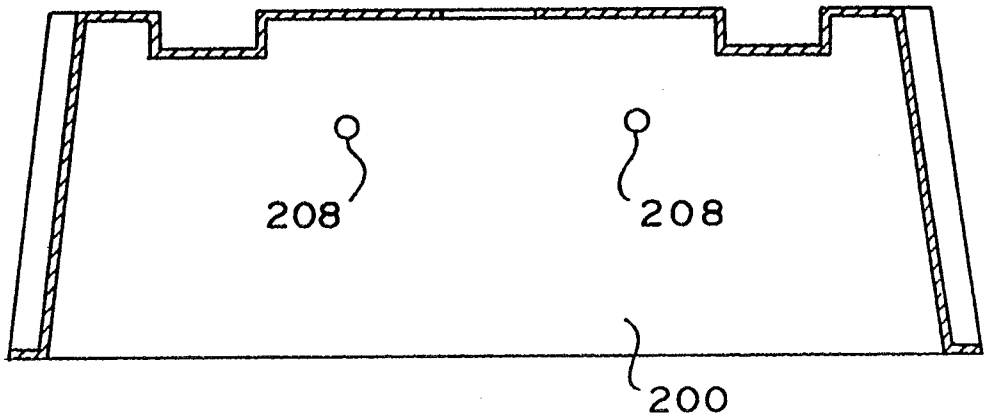
FIG. 15 shows a further cross-section view of the ground anchor housing of FIG. 13.

The concrete or other compound is poured into the inverted housing 200 in the same manner as described previously, and allowed to set and cure, thus freezing the handles 202 into the position depicted in FIG. 14. One function accomplished by handles 202 is the same function provided by dowels 18 in the previously disclosed embodiment, namely serving to aid in retaining the concrete or other compound within the anchor housing 200. The handles 202 provide the additional important function of giving the person who will be installing the anchor housing in the ground an easily grippable and readily accessible member on either side of the anchor to lower the base into the cavity dug in the ground to receive the anchor housing. Because it is desirable to install the housing in the ground with a reasonable degree of precision in terms of depth and alignment with other bases, the installation procedure may require more than one attempt at preparing the ground cavity and lowering the anchor housing filled with cured concrete into the cavity. The handles make this a far less tedious task, and therefore the anchor housing will more likely be installed with the desired degree of precision.

Further, many playing fields from time to time will be switched from one level or type of baseball or softball to another having a different set of rules governing distances between home plate and first and third bases, and consequently between first and second bases and second and third bases. The handles 202 on the ground anchor 200 again greatly facilitate the task of moving the ground anchors from one installation position to another on the field. It will, of course, be recognized that fields undergoing frequent base distance changes will preferably be equipped with two or more sets of ground anchor housings installed at the required spacings such that the anchors are not required to be moved frequently.

One further advantage provided by the handles 202 is that they will tend to retain the housing in place in the ground by providing additional resistance to twisting and lifting forces.

Figure 17:
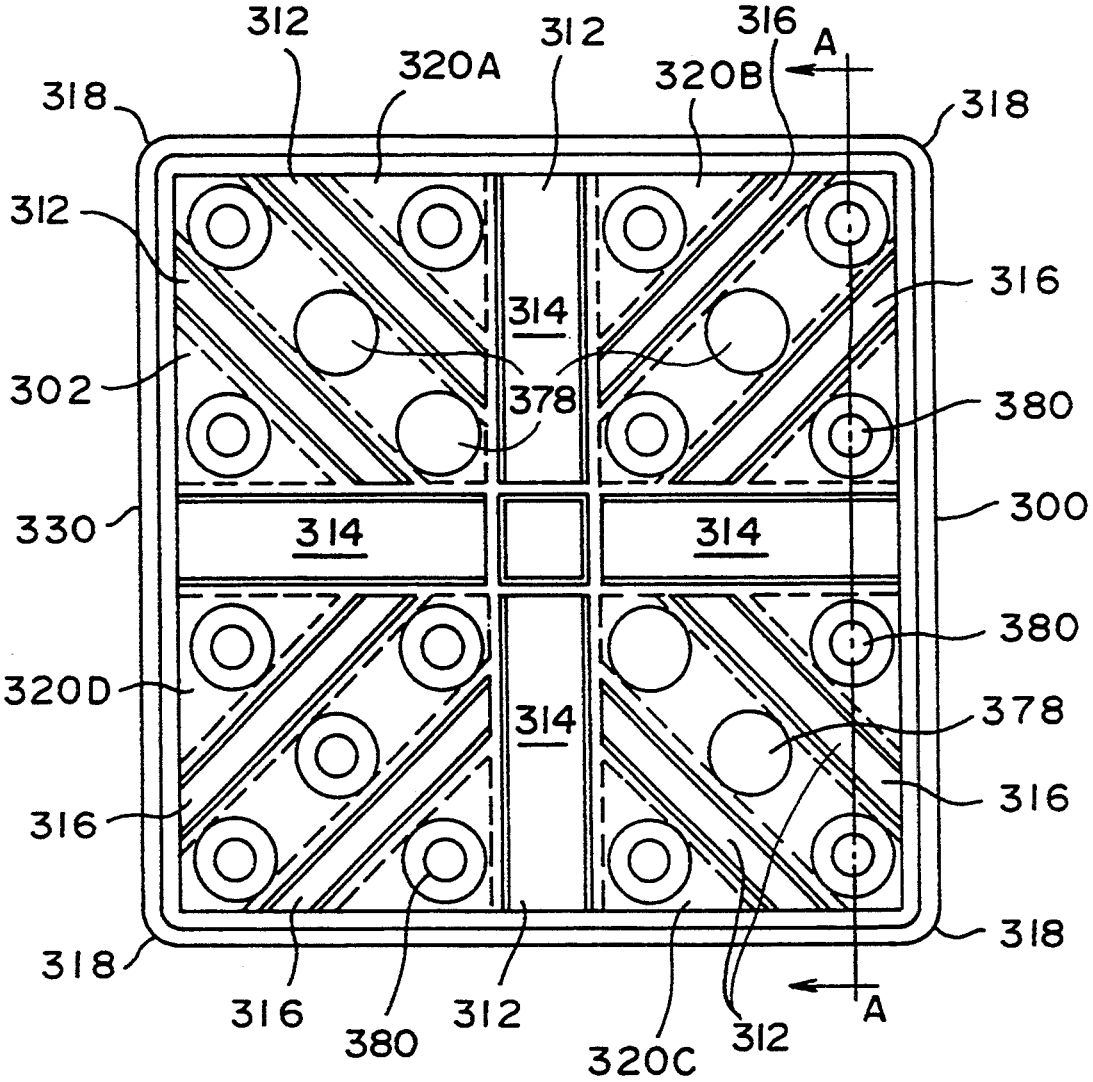
FIG. 17 shows a bottom view of a base according to an alternative preferred embodiment of the present invention.
Figure 18:
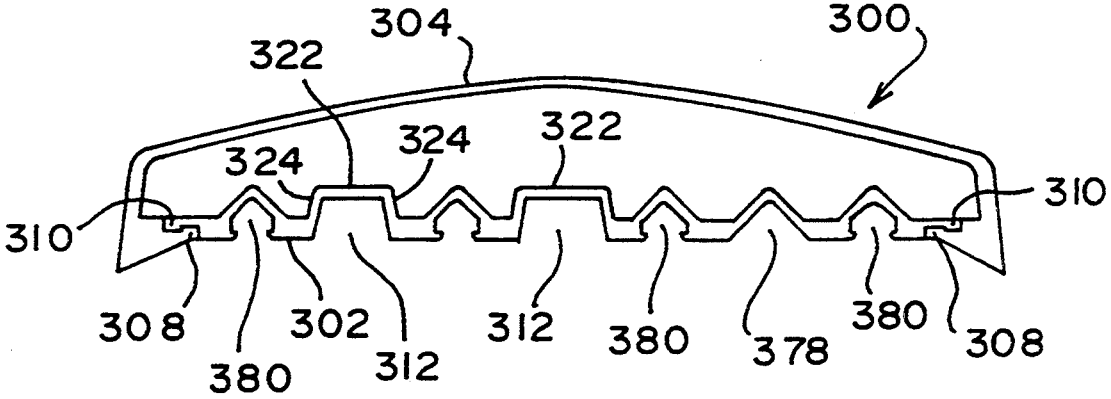
FIG. 18 shows a cross-section view of the base of FIG. 17 taken along section line A—A of FIG. 17.

FIGS. 17 and 18 depict an alternative embodiment of the base 300 wherein the base bottom surface 306 is of primary interest. It should first be noted that the base top 304 and base bottom 306 as depicted are two separate elements joined mechanically by interlocking as well as by suitable adhesive at base top flange 308 and base bottom flange 310, as opposed to being of a substantially "unibody" construction as depicted and previously described with respect to the embodiment shown in FIG. 4. This allows the base, if desired, to be manufactured having a base top of a different density and hardness than that of the base bottom. As a result, greater control over the characteristics of the base, such as the severability characteristics during a slide and the resiliency or "feel" of the base during base running, can be achieved.

Base bottom 306 is provided with a plurality of integral structural recesses or channels 312, which allow for greater control over the rigidity of the base and thus the severability characteristics when the base experiences lateral or shearing forces. The recesses 312 further improve the characteristics of the base in terms of resistance to fatigue, which is an important design criterion in that fatigue of the cover material and the interior foam are significant components of the performance of the base over extended periods of time.

As seen in FIG. 17, recesses or channels 314 are provided extending in directions perpendicular to the peripheral edges of the base bottom 306, and recesses 316 are also provided which extend diagonally in the directions of the base corners 318. In the depicted embodiment, recesses 314 extend between the quadrants 320 containing the fastening means, while the diagonal recesses 316 are disposed to extend through the quadrants 320 A,B, C, D, between the individual conical depressions 378 and fastening recesses or base receiving holes 380. For illustrative purposes, FIG. 17 shows in the quadrants 320A, 320B, 320C and 320D, varying numbers of depressions 378 and fastening recesses 380, which reflect the preferred arrangements for a youth or teen base 320A, 320C (3 fastening recesses, 2 depressions), an adult base 320B (4 fastening recesses, 1 depression), and the pro base 320D (5 recesses, 0 depressions). As noted previously, all of these arrangements can be used with the same intermediate support structure having five upwardly extending resilient fasteners of a shape substantially complementary to the interior of the fastening recesses. It will be recognized by those skilled in the art that as few as one fastening recess per quadrant may be used, preferably, for example, with pre-Little League age children. Further, it would be possible to have more than five fastening recesses per quadrant, provided a corresponding number of upwardly extending resilient fasteners are provided on the intermediate support structure of the base system.

The recesses or channels 312 provide a degree of resistance to bending of the base, for example at a corner 318 or a side 330 of the base, out of its original "planar" disposition. This aids in distributing laterally applied forces across the lateral extent of the base, which is believed to aid in more consistently effecting a progressive dislodgement of the base from the intermediate support structure when a somewhat incorrectly executed slide produces excessive lateral force on the base, while at the same time not compromising the ability of the base to quickly and completely dislodge when even higher levels of excessive lateral forces are produced on the base due to a completely incorrectly executed slide.

The integrally formed recesses or channels 312 will thus comprise one additional design component in producing a base or set of bases having the desired performance characteristics. The improved control over the reaction of the base to lateral forces comes from being able to change the height of the channels, which may preferably be from about one-half to three-quarters of an inch in height, the number of channels, the position of the channels, and other parameters associated with the channels.

As can be seen in FIG. 18, the channel 312 forms a raised platform 322 with side walls 324 at the interior of the base. The base cover material is somewhat more rigid than, and is believed to be more resistant to fatigue under repeated compressive loading than, the foam core of the base. As such, the channels will aid in retaining the structural integrity of the base, including the "crown" of the upper surface thereof, over longer periods of use, as compared with a base having a substantially flat lower surface.

It has been previously noted herein that, as one parameter for achieving the desired severability characteristics for a base, the density, rigidity or hardness of the resilient exterior of the base can be varied according to the level of play with which the base is to be used. Further, the foam density can be varied to render the base more or less rigid. Table I below presents a listing of preferred ranges of hardnesses for the base top and base bottom, and the weight of the foam pad or core designed for various levels of play throughout the mini-youth, youth, teen, adult, and pro (including college baseball) categories of players.

As can be seen in the table, the hardness of the base top and base bottom preferably falls with a range of about 40–90 Durometer A hardness, although it is contemplated that the hardness value can be outside of this range, for example, as low as 30 and as high as 100 on the Durometer A scale. The figures presented for the foam core are in weight and not density, however, as the figures presented are all directed to the same size base (15" square) the foam core density is readily correlated to the weights presented in the table.

The notations found at the far right of Table I are provided to illustrate that within the particular levels of play (mini-youth, youth, teen, adult, pro) designated, the base having the mechanical properties set forth in a given row will be particularly suitable for use in low temperature (LT) climates, normal temperature (N) climates, high temperature (HT) climates, and very high temperature (VHT) climates. As a rough example, taking into consideration the temperatures at which it is suitable to play baseball or softball, low temperature may be defined as below 65° F., normal being between 65°–80° F., with high temperature being between 80°–90°, and very high temperature being in excess of 90° F. This information is set forth in Table I as further evidence of the considerations which must be taken into account in designing a base and base system which will perform reliably in reducing the potential for injury to baseball and softball players.

TABLE I

| LEVEL | CATEGORY | BASE TOP | BASE BOTTOM | FASTENING RECESSES | FOAM CORE | DESCRIPTOR |
|---|---|---|---|---|---|---|
| 1 | Mini YOUTH | 40 Durometer A | 40 Durometer A | 4 | .7 kg | LT |
| 2 | Mini YOUTH | 40 Durometer A | 40 Durometer A | 4 | .8 kg | N |
| 3 | Mini YOUTH | 40 Durometer A | 40 Durometer A | 4 | .9 kg | HT |
| 4 | Mini YOUTH | 40 Durometer A | 40 Durometer A | 4 | 1.0 kg | VHT |
| 5 | YOUTH | 40 Durometer A | 50 Durometer A | 8 | .7 kg | LT |
| 6 | YOUTH | 40 Durometer A | 50 Durometer A | 8 | .8 kg | N |
| 7 | YOUTH | 40 Durometer A | 50 Durometer A | 8 | .9 kg | HT |
| 8 | YOUTH | 40 Durometer A | 50 Durometer A | 8 | 1.0 kg | VHT |
| 9 | TEEN | 50 Durometer A | 50 Durometer A | 12 | .8 kg | LT |
| 10 | TEEN | 50 Durometer A | 50 Durometer A | 12 | .9 kg | N |
| 11 | TEEN | 50 Durometer A | 50 Durometer A | 12 | 1.0 kg | HT |
| 12 | TEEN | 50 Durometer A | 50 Durometer A | 12 | 1.1 kg | VHT |
| 13 | ADULT | 50 Durometer A | 60 Durometer A | 16 | .9 kg | LT |
| 14 | ADULT | 50 Durometer A | 60 Durometer A | 16 | 1.0 kg | N |
| 15 | ADULT | 50 Durometer A | 60 Durometer A | 16 | 1.1 kg | HT |
| 16 | ADULT | 50 Durometer A | 60 Durometer A | 16 | 1.2 kg | VHT |
| 17 | ADULT | 60 Durometer A | 60 Durometer A | 16 | 1.0 kg | Durability |
| 18 | ADULT | 60 Durometer A | 60 Durometer A | 16 | 1.1 kg | Durability |
| 19 | ADULT | 60 Durometer A | 60 Durometer A | 16 | 1.2 kg | Durability |
| 20 | ADULT | 60 Durometer A | 60 Durometer A | 16 | 1.3 kg | Durability |
| 21 | PRO | 60 Durometer A | 70 Durometer A | 20 | 1.0 kg | LT |
| 22 | PRO | 60 Durometer A | 70 Durometer A | 20 | 1.1 kg | N |
| 23 | PRO | 60 Durometer A | 70 Durometer A | 20 | 1.2 kg | HT |
| 24 | PRO | 60 Durometer A | 70 Durometer A | 20 | 1.3 kg | VHT |
| 25 | PRO | 70 Durometer A | 70 Durometer A | 20 | 1.0 kg | Durability |
| 26 | PRO | 70 Durometer A | 70 Durometer A | 20 | 1.1 kg | Durability |
| 27 | PRO | 70 Durometer A | 70 Durometer A | 20 | 1.2 kg | Durability |
| 28 | PRO | 70 Durometer A | 70 Durometer A | 20 | 1.3 kg | Durability |
| 29 | PRO | 70 Durometer A | 80 Durometer A | 20 | 1.0 kg | Max. Hold LT |
| 30 | PRO | 70 Durometer A | 80 Durometer A | 20 | 1.1 kg | Max. Hold N |
| 31 | PRO | 70 Durometer A | 80 Durometer A | 20 | 1.2 kg | Max. Hold HT |

TABLE I-continued

| LEVEL | CATEGORY | BASE TOP | BASE BOTTOM | FASTENING RECESSES | FOAM CORE | DESCRIPTOR |
|---|---|---|---|---|---|---|
| 32 | PRO | 70 Durometer A | 80 Durometer A | 20 | 1.3 kg | Max. Hold VHT |
| 33 | PRO | 80 Durometer A | 80 Durometer A | 20 | 1.0–1.3 kg | Max. Hold |
| 34 | PRO | 80 Durometer A | 90 Durometer A | 20 | 1.0–1.3 kg | Max. Hold |

Although the present description includes various details and particular structures, it is to be understood that these are for illustrative purposes only. Various modifications and adaptations will be apparent to those of ordinary skill in the art. Accordingly, the scope of the present invention should be determined by reference to the claims appended hereto.

What is claimed is:

1. A base adapted to be attached to a ground support structure comprising:

means for fastening said base to a lower ground support, said fastening means being disposed on a lower surface of said base and being operable to sever from said lower ground support upon experiencing a predetermined level of lateral force on said base, said lower surface of said base having a peripheral bevel extending outwardly and downwardly from the edges of said lower surface;

said base having a plurality of channel means integrally formed in said lower surface of said base, said channel means being so constructed and arranged to extend upwardly toward a top surface of said base, and extending outwardly along the lower surface substantially to said peripheral bevel, said channel means being provided for aiding in distributing lateral forces applied at one portion of the base across at least a portion of the remainder of said base.

2. A base as recited in claim 1 wherein said fastening means comprises a plurality of fastening recesses, and wherein said predetermined level of lateral force at which said base will at least partially sever from said lower ground support is dependent upon the number of fastening recesses provided on said base.

3. A base as recited in claim 2 wherein the number of fastening recesses is in the range of 4–20 recesses.

4. A base as recited in claim 1 wherein hardness of said resilient outer casing is in the range of about 40–90 on a Durometer A scale.

5. A base as recited in claim 1 wherein said density of a foam core disposed in said base is in the range of about 0.7 kg–1.3 kg.

6. A base as recited in claim 1 wherein said base comprises a resilient outer casing and wherein said casing is constructed in two pieces comprising a base top having said upper surface and peripheral side surfaces extending downwardly from said upper surface, and a base bottom forming a lower surface containing said fastening means.

7. A base as recited in claim 6 wherein said base top is of a different hardness than said base bottom.

8. A base as recited in claim 7 wherein said base top is of a lower hardness than said base bottom.

9. A base as recited in claim 1 wherein said predetermined level of lateral force at which said base will sever from said lower ground support is dependent upon the number of fastening means disposed on said underside of said base.

10. A base as recited in claim 9 wherein said fastening means comprises a plurality of fastening recesses.

11. A base as recited in claim 10 wherein said base has a resilient outer casing and wherein a hardness of said resilient outer casing is in the range of about 40–90 on a Durometer A scale.

12. An athletic base system comprising:

a lower ground support having a rigid support member and a plurality of resilient fastening means, said fastening means operable to mate with fastening means disposed on an exterior covering of a base placed above said lower ground support; and a plurality of bases selectively and severably attachable to said lower ground support by way of said fastening means, each base having a resilient exterior covering and a foam interior, and wherein said bases sever from the ground support at different lateral forces due to differences in characteristics of the bases, said characteristics selected from the group consisting of:

variations in a thickness of said exterior covering, variations in density of said foam interior, and variations in both exterior covering thickness and foam interior density.

13. An athletic base system comprising:

a lower ground support having a rigid support member and fastening means for severably retaining a base on a top surface thereof; and a plurality of bases having, as part of an exterior covering thereof, base fastening means for severably mating with said fastening means of said ground support, the exterior covering of each of said plurality of bases having a predetermined thickness and density, the exterior covering of a first one of said plurality of bases being different from an exterior covering of a second one of said plurality of bases, said difference in exterior covering between said first and said second base comprising a physical characteristic of said exterior covering selected from the group consisting of:

a) said thickness of said exterior covering;

b) said density of said exterior covering; and c) said thickness and said density of said exterior covering; whereby said fastening means of said first one and said second one of said plurality of bases are of a character such that said first one of said plurality of bases will release from said lower ground support at a different level of applied lateral force than will said second one of said plurality of bases.

* * * * *